United States Patent [19]

Cummings et al.

[11] 4,111,077

[45] Sep. 5, 1978

[54] RATCHET WRENCH

[75] Inventors: Henry S. Cummings; Richard P. Leone, both of Worcester, Mass.

[73] Assignee: Lowell Corporation, Worcester, Mass.

[21] Appl. No.: 764,861

[22] Filed: Feb. 2, 1977

[51] Int. Cl.[2] ..... B25B 13/46

[52] U.S. Cl. ..... 81/63

[58] Field of Search ..... 81/60–63.2

[56] References Cited

U.S. PATENT DOCUMENTS

| | | | |
|---|---|---|---|
| 895,757 | 8/1908 | Hollandsworth | 81/60 |
| 1,378,719 | 5/1921 | Poole | 81/57.3 |
| 1,578,065 | 3/1926 | Bemus et al. | 81/62 |
| 2,507,455 | 5/1950 | Ott | 81/61 |
| 3,564,954 | 2/1971 | LaPointe | 81/61 |
| 3,742,788 | 7/1973 | Priest | 81/61 |

FOREIGN PATENT DOCUMENTS

| | | | |
|---|---|---|---|
| 1,374,052 | 11/1974 | United Kingdom | 81/63 |

*Primary Examiner*—James L. Jones, Jr.
*Attorney, Agent, or Firm*—Norman S. Blodgett; Gerry A. Blodgett

[57] ABSTRACT

Ratchet wrench having a main body consisting of two body elements formed of stamped metal plate having handle portions that are riveted together and having head portions which are offset from the handle portion so as to lie in spaced, parallel relationship, the head portions supporting a ratchet and a pawl between them.

6 Claims, 8 Drawing Figures

RATCHET WRENCH

BACKGROUND OF THE INVENTION

In the design and manufacture of ratchet wrenches, it has been common practice in the past to use a main body in the form of a steel forging or an iron casting with a hollow head for carrying the sprocket, pawl, and shifter mechanisms. In addition to being very expensive, such castings make the wrench quite heavy. Furthermore, in the dirty atmosphere to which most wrenches are subjected, abrasive material accumulates in the chamber which holds the mechanism and not only causes wear, but also causes the mechanism to bind. Also, the complexity of such prior art wrenches does renders them not only more expensive, but also more subject to deterioration. These and other difficulties experienced with the prior art devices have been obviated in a novel manner by the present invention.

It is, therefore, an outstanding object of the invention to provide a ratchet wrench whose major components consist of a pair of identical sheet metal stampings.

Another object of this invention is the provision of a ratchet wrench which is relatively inexpensive to manufacture.

A further object of the present invention is the provision of a ratchet wrench whose operating mechanism is self-cleaning.

It is another object of the instant invention to provide a ratchet wrench which is simple in construction, which is inexpensive to manufacture, and which is capable of a long life of useful service with a minimum of maintenance.

A still further object of the invention is the provision of a ratchet wrench having an extremely high strength-to-weight ratio and, specifically, is capable of resisting extremely a large force couple in a plane perpendicular to the axis of torquing.

It is a further object of the invention to provide a ratchet wrench having a small number of parts, having a combination shifter and pawl mechanism, having a self-cleaning shifter mechanism, and being extremely easy to manufacture.

With these and other objects in view, as will be apparent to those skilled in the art, the invention resides in the combination of parts set forth in the specification and covered by the claims appended hereto.

SUMMARY OF THE INVENTION

In general, the invention consists of a ratchet wrench having a main body consisting of two similar body elements formed from thin material, each element having an elongated flat handle portion connected to a centrally-apertured head portion which is offset laterally thereof. The handle portions of the two elements are fastened in face-to-face relationship with the head portions in parallel relationship. A spacer element may lie between the head portions at the outer portion thereof on the sides located at the opposite sides of the apertures from the handle portions. An annular sprocket formed with teeth on its outer periphery is rotatably carried in the apertures and held between the head portions. A one-piece pawl is carried between the head portions in the part thereof adjacent the handle portions for rotation about an axis perpendicular to the head portions. The pawl has two spaced, parallel teeth which extend toward the sprocket and alternately engage the sprocket teeth in the extreme positions of rotation of the pawl. The pawl also has two laterally-extending fingers, one finger extending from between the head portions at each of the said extreme positions of the pawl. An over-center spring element engages a control portion of the pawl facing the handle portions.

More specifically, the control portion of the pawl is provided with a concave recess and the spring element includes a spring-loaded plunger with a rounded head. The plunger is slidable in a transverse bore formed in a pivot pin extending between the head portions and rotatable about an axis which is spaced from the parallel to the pawl axis. An expansion spring activates the plunger under compression between the pivot pin and the rounded head. The recess has a central cylindrical surface engaged by the rounded head of the plunger and plane stop surfaces at each end of the cylindrical surface, the stop surfaces being spaced from and parallel to one another.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
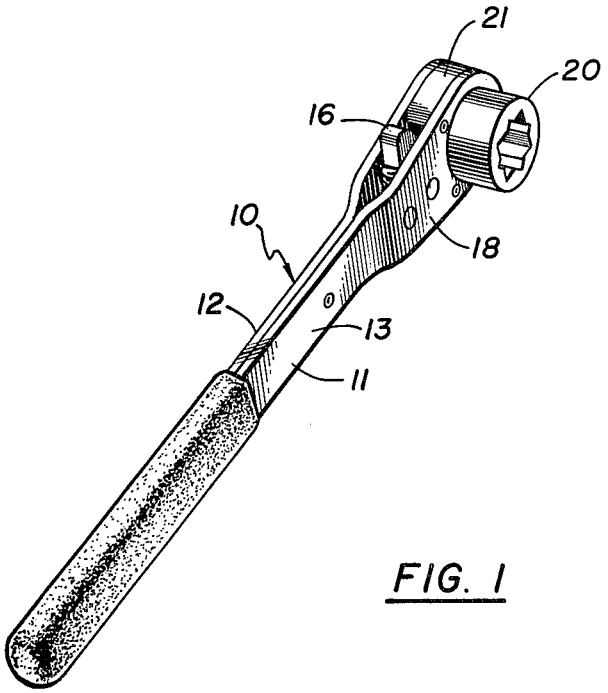
FIG. 1 is a perspective view of a socket wrench embodying the principles of the present invention.
Figure 2:
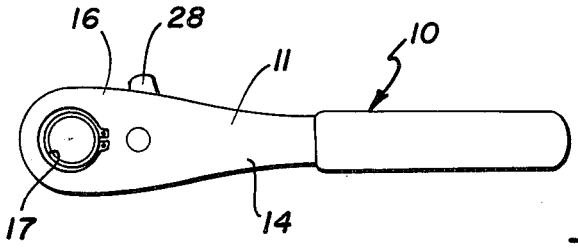
FIG. 2 is a plan view of the wrench.
Figure 3:
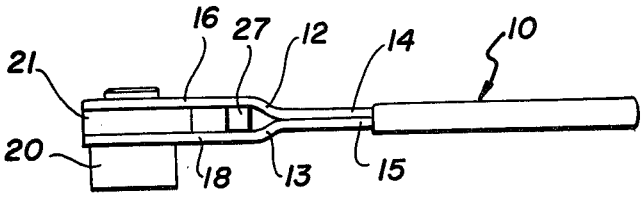
FIG. 3 is a front elevational view of the wrench.

Referring first to FIGS. 1, 2, and 3, wherein are best shown the general features of the invention, the ratchet wrench, indicated generally by the reference numeral 10, is provided with a main body 11, consisting of two similar body elements 12 and 13 stamped from steel plate. The elements 12 and 13 are provided with an elongated flat handle portions 14 and 15, respectively, which are riveted together in face-to-face relationship and at least partially covered with a coating of plastisol to provide for comfortable handling. The handle portion 14 is provided with a laterally-spaced head portion 16 having a central aperture 17, while the handle portion 15 is provided with an offset head portion 18, also having a central aperture 19 (see FIG. 4). Because the head portions are offset in opposite directions, they lie in spaced, parallel relationship with a gap between them that is occupied at the portion furthest away from the handle portions by a spacer 21 formed of a polymer such as nylon. A typical socket 20 is carried by the wrench and extends from one side thereof.

Figure 4:
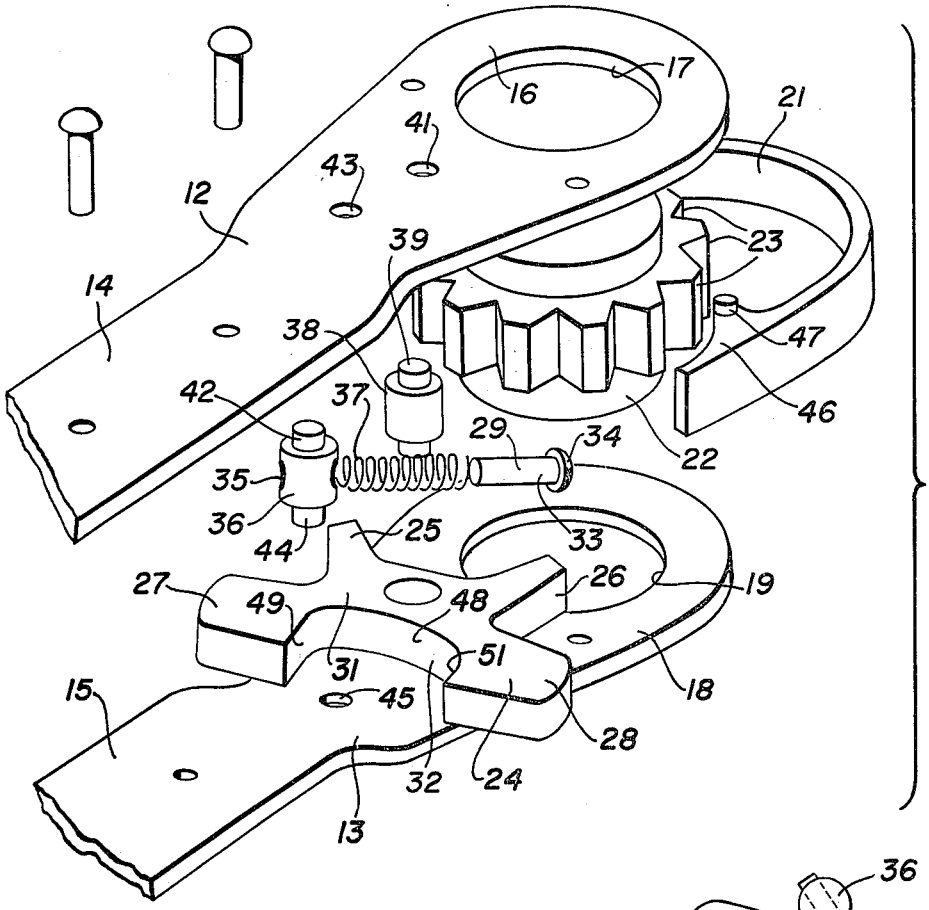
FIG. 4 is an exploded perspective view of a major portion of the wrench.
Figure 6:
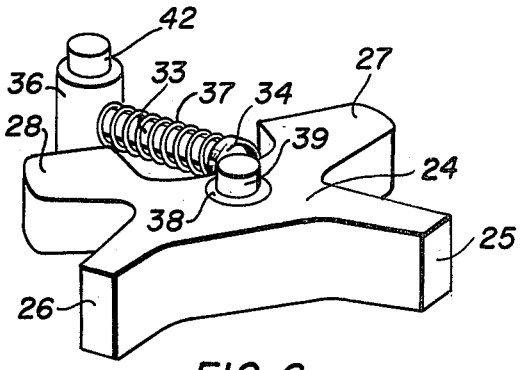
FIGS. 5, 6, 7 and 8 are schematic views showing three operative positions of the shifter-pawl mechanism.

Referring next to FIG. 4, it can be seen that a generally annular sprocket 22 formed with teeth 23 on its outer periphery is rotatably carried in the apertures 17 and 19 and held between the corresponding head portions 16 and 18. The shifter pawl 24 is also carried between the head portions in the parts thereof which are adjacent the handle portions. It is mounted for rotation about an axis which is perpendicular to the planes of the head portions. The pawl is provided with two spaced, parallel teeth 25 and 26 which extend toward the sprocket 22 and alternately engage the teeth 23 of the sprocket in the extreme positions of rotation of the pawl. The pawl is provided with two laterally-extending fingers 27 and 28. One of these fingers extends from the gap between the head portions at each of the extreme positions of the pawl. An over-center spring element 29 engages a control portion 31 of the pawl which forces the handle portions.

The control portion 31 of the pawl 24 includes a recess 32. The spring element 29 includes a spring-loaded plunger 33 with a rounded head 34 which actually engages the surface of the recess. The plunger 33 is slidable in a transverse bore 35 extending through a pivot pin 36. This pin extends between the head portions and is rotatable about an axis which is spaced from and parallel to the pawl axis. A coil spring 37 surrounds the plunger and normally lies under compression between the pivot pin 36 and the head 34 of the plunger. The pawl 24 is rotatably mounted on a pivot pin 38, the upper end of which is provided with a reduced neck 39 which fits in a circular aperture 41 formed in the head portion 12; its lower end is provided with a similar neck which fits in a similar aperture (not shown) in the head portion 13. The ends of the pivot pin 36 are similarly provided with an upper reduced neck 42 which fits in a circular aperture 43 formed in the head portion 12 and with a lower reduced neck 44, which fits in an aperture 45 formed in the head portion 13.

As is evident in FIG. 4, the spacer 21 is generally semi-circular in shape with its outer surface having the shape of the outer periphery of the head portions between which it lies and an inner surface that is spaced from and parallel to the outer ends of the teeth 23 of the sprocket. Its free ends are provided with protuberances which lie closely adjacent the teeth of the sprocket. The protuberance 46 is typical and is provided with a peg 47 for engagement with a corresponding aperture in the head portion 13. The spacer is integrally formed of a polymer, such as nylon.

The recess 32 in the pawl is provided with a central cylindrical surface 48. At the ends of the cylindrical surface 48 are located stop surface 49 and 51 in the form of plane surfaces which are spaced from and parallel to one another.

Figure 8:
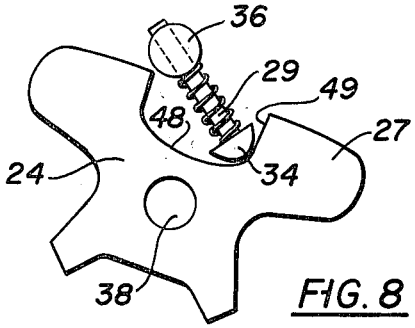
Figure 7:
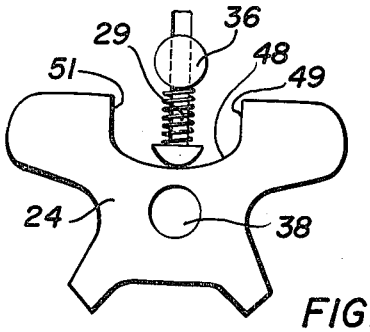
Figure 5:
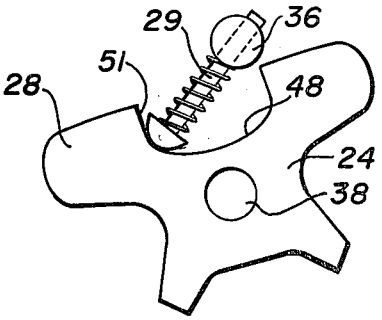

The operation of the invention will now be readily understood in view of the above description, particularly with reference to FIGS. 7, 8, and 9. As is evident in FIG. 7, when the pawl 24 is located in its central or "transition" position, the plunger 29 is located in the central portion of the recess surface 48 and is an alignment between the axis of the pivot pin 36 and the axis of the pivot pin 38. In order to arrange the apparatus for "clockwise" drive of a socket 20, the finger 27 is pressed to rotate the pawl to the extreme position shown in FIG. 8. In this condition the head 34 of the plunger lies in the corner formed between the stop surface 49 and the surface 48. Also, the finger 27 extends from the gap between the head portions. In order to use the wrench for "counter-clockwise" driving of the socket 20, the finger 27 is actuated to press the pawl through the transition condition into the extreme position shown in FIG. 9, wherein the head of the plunger resides in the corner between the surface 48 and the stop surface 51.

It can be seen, therefore, that the present invention provides a ratchet wrench which makes use of identical steel stampings having an external shape of the ratchet arm and the appropriate internal apertures. The handles are bent in an offset manner, so that, when two such stampings are placed back-to-back, the sprocket gear may be inserted in the head. The two stamping are then riveted together. Only two additional parts are required, namely the spring assembly and the pawl, all of which are assembled before riveting the stamp parts together. The result is a wrench having a small number of moving parts with a pawl which serves a multiple function as a shifter, as well as a pawl. Also of interest is the function of the spring element, which serves as a pivot, and the self-cleaning action of the shifting action of the pawl and the spring. The handle is adaptable for connecting to operating yokes or mechanisms and it may be shortened simply by shearing it for use in various ratcheting applications. The entire wrench is quite thin, thus permitting its application to mechanisms where this feature is important. It can be used for tightening nuts on long bolts which can pass entirely through the head.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Ratchet apparatus, comprising:

(a) a main body consisting of two similar body elements formed of thin material, each element having an elongated flat panel portion connected to a centrally-apertured head portion which is offset laterally thereof, the handle portions of the two elements being fastened in face-to-face relationship with the head portion in spaced, parallel relationship, (b) a generally annular sprocket formed with teeth on its outer periphery, rotatably carried in the apertures and held between the head portions, (c) a generally semi-circular spacer element lying between the head portions at the outer parts thereof on the opposite sides of the apertures from the handle portions and surrounding a portion of the sprocket, said spacer element having an inwardly-directed protuberance at each end, the protuberances being adjacent the outer ends of the sprocket teeth, the spacer element being formed of a polymer and each protuberance being provided with a peg which engages an aperature in the head portion, the peg being in the form of a rod whose axis is perpendicular to the head portions, (d) a one-piece pawl carried between the head portions in the part thereof adjacent the handle portions for rotation about an axis perpendicular to the head portions, the pawl having two spaced, parallel teeth extending toward the sprocket and alternately engaging the sprocket teeth in the extreme positions of rotation of the pawl, the pawl having two laterally-extending fingers, one finger emerging from between the head portions and each of the said extreme positions of the pawl, and (e) an over-center spring element engaging a control portion of the pawl facing the handle portions.

2. Ratchet apparatus as recited in claim 1, wherein the said control portion of the pawl is provided with a concave recess, and wherein the spring element includes a spring loaded plunger with a rounded head.

3. Ratchet apparatus as recited in claim 2, wherein the plunger is slidable in a transverse bore formed in a pivot pin extending between the head portions and rotable about an axis which is spaced from and parallel to the pawl axis, and wherein a coil spring surrounds the plunger under compression between the pivot pin and the said head.

4. Ratchet apparatus as recited in claim 3, wherein the pawl is rotatably mounted on a pivot pin, wherein the pawl pivot pin and the spring element pivot pin are both provided with reduced necks at their ends which lie in apertures formed in the head portions.

5. Ratchet apparatus as recited in claim 2, wherein the recess has a central cylindrical surface engaged by the rounded head of the plunger and stop surfaces at each end of the cylindrical surface, the stop surfaces being plane, spaced from, and parallel to one another.

6. Ratchet apparatus as recited in claim 1, wherein the said body elements are stamped from sheet steel.

* * * * *